US008761617B2

(12) United States Patent
Kaji

(10) Patent No.: US 8,761,617 B2
(45) Date of Patent: Jun. 24, 2014

(54) IMAGE FORMING APPARATUS

(75) Inventor: Hajime Kaji, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 709 days.

(21) Appl. No.: 12/473,941

(22) Filed: May 28, 2009

(65) Prior Publication Data

US 2009/0297172 A1 Dec. 3, 2009

(30) Foreign Application Priority Data

May 30, 2008 (JP) ..... 2008-143167

(51) Int. Cl.
*G03G 15/00* (2006.01)

(52) U.S. Cl.
USPC ..... 399/13; 399/24; 399/111

(58) Field of Classification Search
USPC ..... 399/12, 13, 24, 27, 110, 11, 113, 399/222–224, 227, 252–256, 262, 263
See application file for complete search history.

(56) References Cited

U.S. PATENT DOCUMENTS

| | | | | |
|---|---|---|---|---|
| 2005/0254840 | A1* | 11/2005 | Saisu et al. | 399/12 |
| 2007/0003296 | A1* | 1/2007 | Miyata | 399/27 |
| 2007/0217798 | A1* | 9/2007 | Tsuji et al. | 399/27 |
| 2007/0286616 | A1* | 12/2007 | Kojima et al. | 399/27 |
| 2008/0298820 | A1* | 12/2008 | Sugiura | 399/12 |

FOREIGN PATENT DOCUMENTS

JP 2001-356576 A 12/2001

* cited by examiner

*Primary Examiner* — Walter L Lindsay, Jr.
*Assistant Examiner* — Jessica L Eley
(74) *Attorney, Agent, or Firm* — Rossi, Kimms & McDowell LLP

(57) ABSTRACT

An image forming apparatus which is capable of reducing a time before an image formation operation is started after toner bottle replacement. When a toner sensor detects that toner is out, and further a door sensor detects that there is a possibility that a toner bottle has been replaced, a toner replenishment rate is calculated from the rotational speed of a motor for rotating the toner bottle, and timing in which image formation is to be resumed is determined based on the toner replenishment rate.

10 Claims, 6 Drawing Sheets

| TONER BOTTLE MOTOR ROTATIONAL SPEED (rpm) | TONER REPLENISHMENT RATE (g/m) |
|---|---|
| 40 OR MORE | 1 |
| 30~40 | 2 |
| 20~30 | 5 |
| 20 OR LESS | 10 |

*FIG. 7*

| TONER BOTTLE MOTOR ROTATIONAL SPEED (rpm) | TONER REPLENISHMENT RATE (g/m) |
|---|---|
| 40 OR MORE | 1 |
| 30~40 | 2 |
| 20~30 | 5 |
| 20 OR LESS | 10 |

IMAGE FORMING APPARATUS

BACKGROUND OF THE INVENTION

1. Field of the Invention

The present invention relates to an image forming apparatus (electrophotographic apparatus), such as a printer, a copying machine, or a facsimile machine, and more particularly to an image forming apparatus characterized by a motor control technique for driving a toner bottle of the apparatus for rotation.

2. Description of the Related Art

Conventionally, a toner replenishment unit of an image forming apparatus for replenishing toner from a toner bottle is comprised of a motor (toner bottle motor) formed by a brush motor or a brushless motor, and a toner sensor in a sub hopper or a development device replenished with toner. Further, an image forming apparatus has also been proposed which is provided, to detect stoppage of tonner due to toner condensation, with a rotation detection unit for detecting rotation of a toner bottle or a stirring member (see Japanese Patent Laid-Open Publication No. 2001-356576).

In the image forming apparatus having the above-mentioned arrangement, toner is replenished from the toner bottle by rotating the toner bottle using the motor or rotating the stirring member in the toner bottle.

Further, if a sensor is provided in the toner bottle for detecting presence of toner, this complicates the construction and increases manufacturing costs. Therefore, the toner sensor is provided in the sub hopper or in the development device arranged within the main unit of the image forming apparatus.

Toner replenishment control is performed such that an image formation operation is stopped if it is detected that the toner is out, and after replacement of the toner bottle, the motor is rotated to continue a toner replenishing operation until it is detected by the toner sensor that the toner is present, whereafter the image formation operation is resumed.

Hereafter, a description will be given of the toner replenishment control periodically performed when the power is on and control for toner bottle replacement.

The toner sensor in the above-mentioned sub hopper detects whether or not toner is present, and if it is detected that the toner is present, the image forming apparatus is ready for image formation. If it is detected that the toner is out, the toner replenishment is performed by rotating the toner bottle or the stirring member in the toner bottle by the motor. While performing the toner replenishment, it is detected whether or not the toner is present.

If it continues to be detected that the toner is out in spite of continuing the toner replenishment for a predetermined time period, and further, if a toner sensor in the development device for detecting toner therein detects that the toner is out, the image formation operation is interrupted. Then, a replacement message or the like is displayed on a display section, for notifying the user that the toner in the toner bottle is out.

Thereafter, it is determined whether or not there is a possibility that the toner bottle has been replaced. This is carried out by detecting opening/closing of a door which is opened and closed when the toner bottle is replaced, using an opening/closing sensor. If it is determined that there is a possibility that the toner bottle has been replaced, the toner replenishing operation is started again.

The toner replenishing operation is continued until the toner sensor in the sub hopper detects that the toner is present, and when the toner sensor detects that the toner is present, the image formation operation is started again.

The image forming apparatus is controlled such that the image formation operation is not performed in a state in which the toner is out, by repeating the above-described sequence.

In a recovery operation for the above-described conventional image forming apparatus at the time of detecting that the toner is out, first, immediately after the toner sensor in the development device detects that the toner is out, the image formation operation is interrupted and an indication for toner replacement is displayed on the display section. Then, if a door-opening/closing operation is detected, the toner replenishing operation is started and continued until the toner sensor in the sub hopper detects that the toner is present. When the toner sensor detects that the toner is present, the image formation operation is started.

That is, when the user replaces the toner bottle, the image forming apparatus remains in a state in which the image formation operation is interrupted until the sub hopper is filled with the toner. This brings about a problem that it takes a long recovery time before the image formation operation is started after toner bottle replacement.

SUMMARY OF THE INVENTION

The present invention provides an image forming apparatus which is capable of reducing a time before an image formation operation is started after toner bottle replacement.

The present invention provides an image forming apparatus comprising a motor configured to rotate a toner bottle to convey toner from the toner bottle to a toner storage unit, a rotating state-detecting unit configured to detect a rotating state of the motor, a toner presence-detecting unit configured to detect whether or not toner is present in the toner storage unit, a toner bottle replacement-detecting unit configured to detect that there is a possibility that the toner bottle has been replaced, and a control unit configured to be operable when it is detected by the toner presence-detecting unit that the toner is out, and further it is detected by the toner bottle replacement-detecting unit that there is a possibility that the toner bottle has been replaced, to drive the motor rotate the tonner bottle and determine timing in which image formation is to be started, based on the rotating state of the motor detected by the rotating state-detecting unit.

With the arrangement of the image forming apparatus according to the present invention, it is possible to reduce a time before the image formation operation is started after toner bottle replacement.

The features and advantages of the invention will become more apparent from the following detailed description taken in conjunction with the accompanying drawings.

BRIEF DESCRIPTION OF THE DRAWINGS

FIG. 7 is an example of a relationship between the rotational speed of a toner bottle motor appearing in FIG. 5 and a toner replenishment rate.

DETAILED DESCRIPTION OF THE EMBODIMENTS

The present invention will now be described in detail below with reference to the accompanying drawings showing embodiments thereof.

Figure 1:
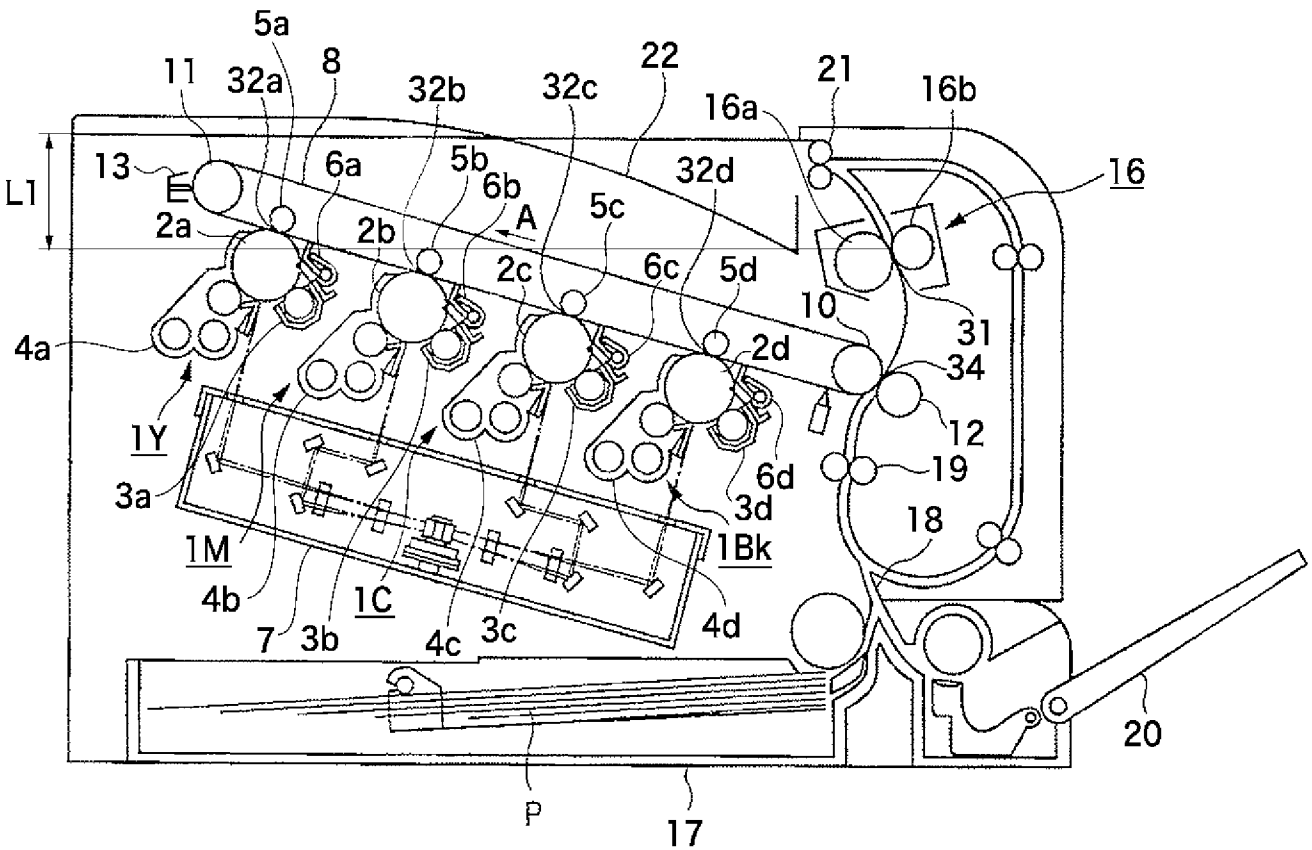
FIG. 1 is a schematic diagram of an image forming apparatus according to an embodiment of the present invention.
Figure 2:
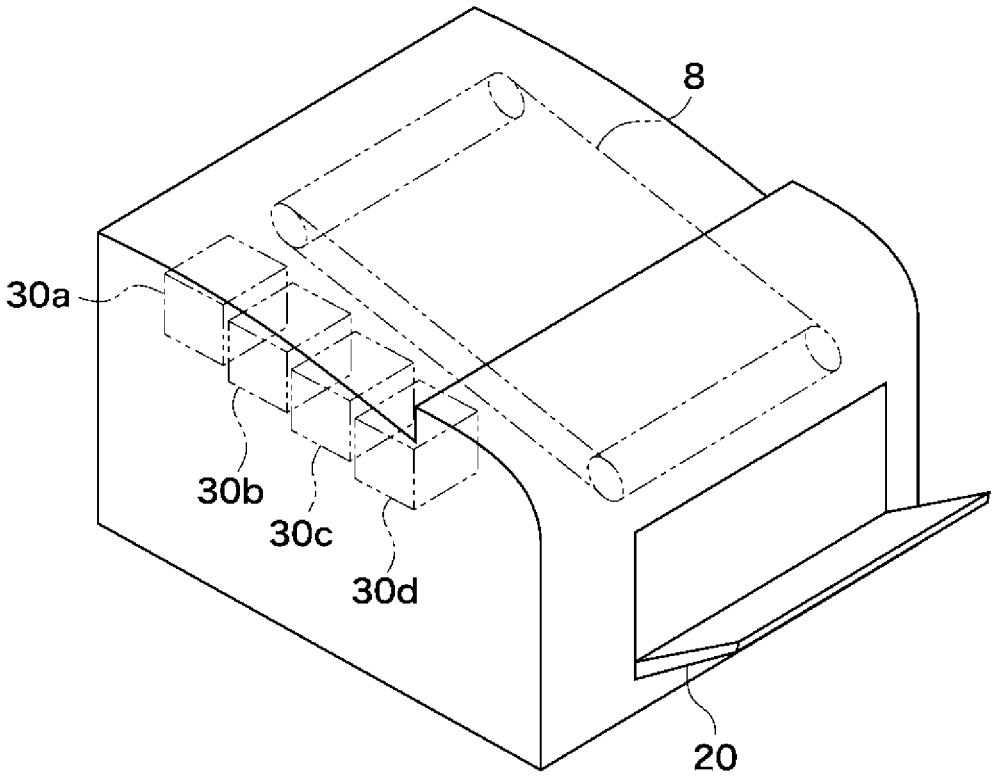
FIG. 2 is a transparent perspective view of the appearance of the image forming apparatus, in which locations of toner bottles are shown.
Figure 3:
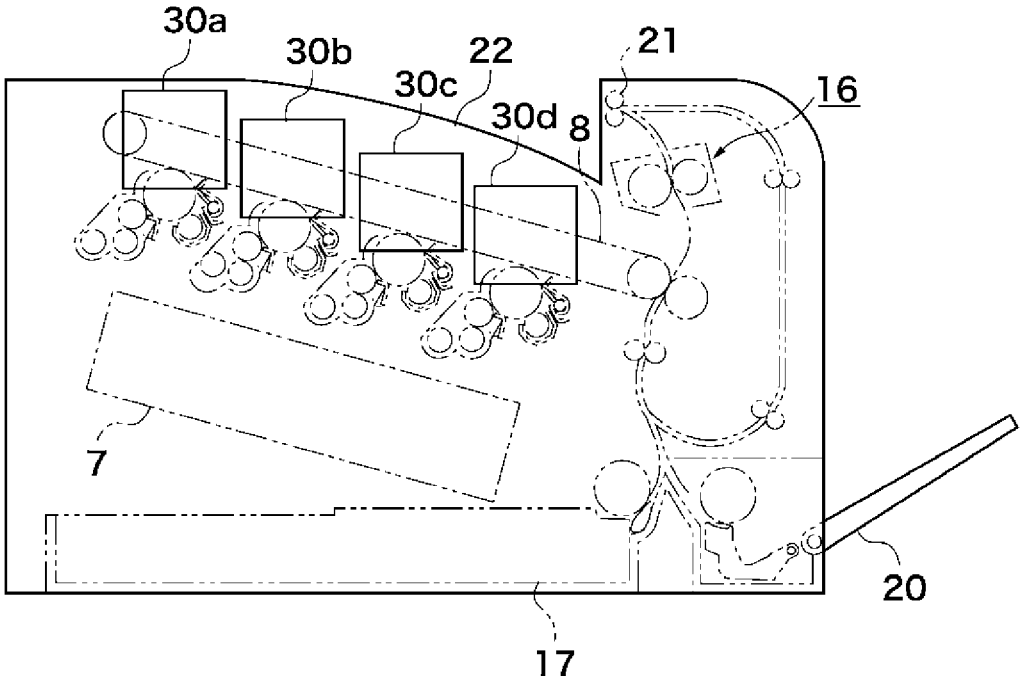
FIG. 3 is a transparent side view of the image forming apparatus in which the locations of the toner bottles are shown.

FIG. 1 is a schematic diagram of an image forming apparatus according to an embodiment of the present invention. FIG. 2 is a transparent perspective view of the appearance of the image forming apparatus appearing in which location of toner bottles are shown, and FIG. 3 is a transparent side view of the image forming apparatus in which locations of the toner bottles are shown.

The image forming apparatus in FIG. 1 is implemented, for example, by an electrophotographic color image forming apparatus including an intermediate transfer belt of a tandem type.

This image forming apparatus is comprised of four image forming sections (image forming units). More specifically, the image forming apparatus is comprised of an image forming section 1Y that forms a yellow image, an image forming section 1M that forms a magenta image, an image forming section 1C that forms a cyan image, and an image forming section 1Bk that forms a black image.

These four image forming sections 1Y, 1M, 1C, and 1Bk are arranged in a row at predetermined space intervals. Arranged below the image forming sections are a cassette 17 as a sheet-feeding unit, and a manual feed tray 20, vertically arranged are a conveying pass 18 for a recording medium P and a registration roller pair 19, and arranged above the conveying pass 18 and the registration roller pair 19 is a fixing unit 16.

Next, a detailed description will be given of each of the units.

In the image forming sections 1Y, 1M, 1C, and 1Bk, there are disposed drum-type electrophotographic photosensitive members (hereinafter referred to as "the photosensitive drums") 2*a*, 2*b*, 2*c*, and 2*d* as image bearing members, respectively.

Around the photosensitive drums 2*a*, 2*b*, 2*c*, and 2*d*, there are arranged primary electrostatic chargers 3*a*, 3*b*, 3*c*, and 3*d*, development devices 4*a*, 4*b*, 4*c*, and 4*d*, transfer rollers 5*a*, 5*b*, 5*c*, and 5*d*, and drum cleaners 6*a*, 6*b*, 6*c*, and 6*d*, respectively.

Further, a laser exposure device 7 is disposed below the primary electrostatic chargers 3*a*, 3*b*, 3*c* and 3*d*, and the development devices 4*a*, 4*b*, 4*c*, and 4*d*.

The photosensitive drums 2*a*, 2*b*, 2*c*, and 2*d* are negatively charged OPC photosensitive members, and each have a photoconductive layer formed on an aluminum drum substrate thereof. The photosensitive drums 2*a*, 2*b*, 2*c*, and 2*d* are each driven by a driving device (not shown) for rotation in a direction (clockwise direction) indicated by an arrow at a predetermined processing speed.

Each of the primary electrostatic chargers 3*a*, 3*b*, 3*c*, and 3*d* uniformly charges the surface of an associated one of the photosensitive drums 2*a*, 2*b*, 2*c*, and 2*d* to a predetermined negative potential by a charge bias applied from a charge bias power source (not shown).

The laser exposure device 7 disposed below the photosensitive drums 2 is comprised of a laser emitting section for emitting light according to a time-series electric digital pixel signal of given image information, polygon lenses, and reflective mirrors.

The laser exposure device 7 irradiates (optically write on) the respective surfaces of the photosensitive drums 2*a*, 2*b*, 2*c*, and 2*d* with laser light to form electrostatic latent images for the respective colors according to the image information on the respective surfaces of the photosensitive drums 2*a*, 2*b*, 2*c*, and 2*d* charged by the respective associated primary electrostatic chargers 3*a*, 3*b*, 3*c*, and 3*d*.

Each of the development devices 4*a*, 4*b*, 4*c*, and 4*d* contains an associated one of a yellow toner, a cyan toner, a magenta toner, and a black toner, and develops (visualizes) an electrostatic latent image formed on the associated one of the photosensitive drums 2*a*, 2*b*, 2*c*, and 2*d* as a toner image by attaching the associated color to the electrostatic latent image.

Figure 4:
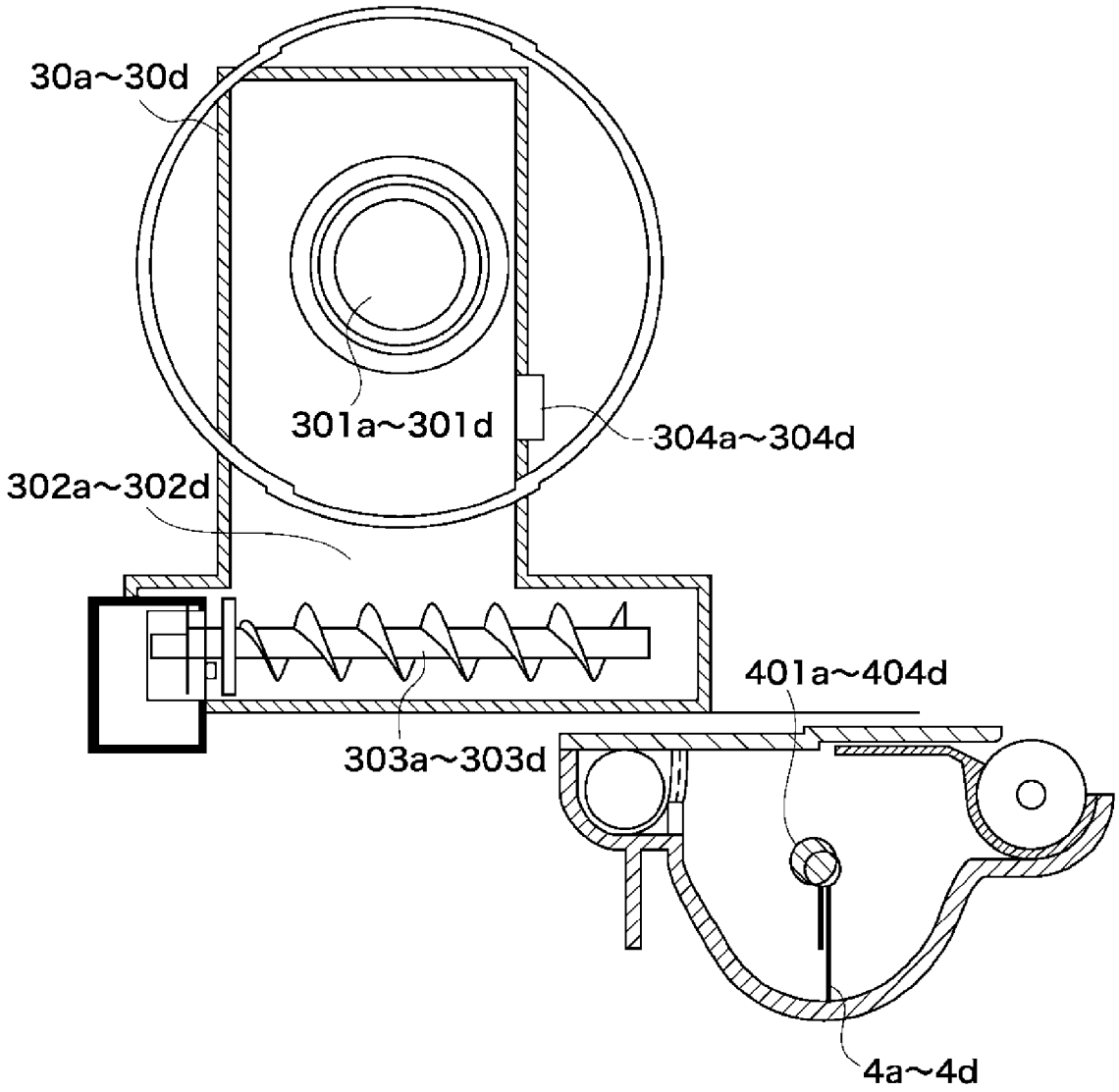
FIG. 4 is a schematic view of a toner replenishment unit and a development device appearing in FIG. 1.

Toners are replenished to the development devices 4 for the colors from the respective associated toner bottles 30*a* to 30*d* for the colors which are set at the respective locations shown in FIGS. 2 and 3, via the sub hoppers shown in FIG. 4.

Now, a description will be given of an arrangement shown in FIG. 4.

FIG. 4 is a block diagram of a toner replenishment unit and one of the development devices appearing in FIG. 1.

The toner replenishment unit is comprised of the toner bottle 30 (30*a* to 30*d*) and a toner bottle motor 301 (301*a* to 301*d*). The toner replenishment unit is further comprised of a sub hopper 302 (302*a* to 302*d*), a sub hopper screw 303 (303*a* to 303*d*), and a toner sensor 304 (304*a* to 304*d*).

The development device 4 (4*a* to 4*d*) is also provided with a toner sensor 401 (401*a* to 401*d*).

The toner replenishment control will be described in detail hereinafter.

Referring again to FIG. 1, each of the transfer rollers 5*a*, 5*b*, 5*c*, and 5*d* is disposed in an associated one of primary transfer sections 32*a*, 32*b*, 32*c*, and 32*d* such that it can be brought into contact with an associated one of the photosensitive drums 2*a*, 2*b*, 2*c*, and 2*d* via an intermediate transfer belt 8. The toner images on the respective photosensitive drums 2 are sequentially transferred by each of the transfer rollers 5 onto the intermediate transfer belt 8 in superimposed relation.

Each of the drum cleaners 6*a*, 6*b*, 6*c*, and 6*d* is formed e.g. by a cleaning blade, and uses the cleaning blade to scrape off toner remaining on the surface of an associated one of the photosensitive drums 2 during primary transfer, to thereby clean the surface of the associated drum.

The intermediate transfer belt 8 is disposed e.g. toward the respective upper surfaces of the photosensitive drums 2*a*, 2*b*, 2*c*, and 2*d* in a manner stretched between a secondary-transfer opposed roller 10 and a tension roller 11. The secondary-transfer opposed roller 10 is disposed in a secondary transfer section 34 such that it can be brought into contact with a secondary-transfer roller 12 via the intermediate transfer belt 8.

The intermediate transfer belt 8 is formed of a dielectric resin, such as a polycarbonate resin film, a polyethylene terephthalate resin film, or a polyvinylidene fluoride resin film.

The images transferred onto the intermediate transfer belt 8 are transferred onto the recording medium P conveyed from a sheet feed unit at the secondary transfer section 34. A belt-cleaning device 13 which removes and collects toner remaining on the surface of the intermediate transfer belt 8 is disposed in the vicinity of the tension roller 11, outside the intermediate transfer belt 8.

The fixing unit 16 is comprised of a fixing roller 16*a* incorporating a heat source, such as a ceramic heater board, and a pressing roller 16*b* (which can incorporate a heat source) which is pressurized by the fixing roller 16*a*. The unfixed toner images on the recording medium are fixed by melting in a nip 31 in which the fixing roller 16*a* and the pressing roller 16*b* are brought into contact with each other.

Further, a sheet discharge roller 21 for guiding the recording medium P outward of the apparatus is disposed downstream of the fixing unit 16 (in a recording medium-conveying direction), and a sheet discharge tray 22 is disposed downstream thereof.

Figure 5:
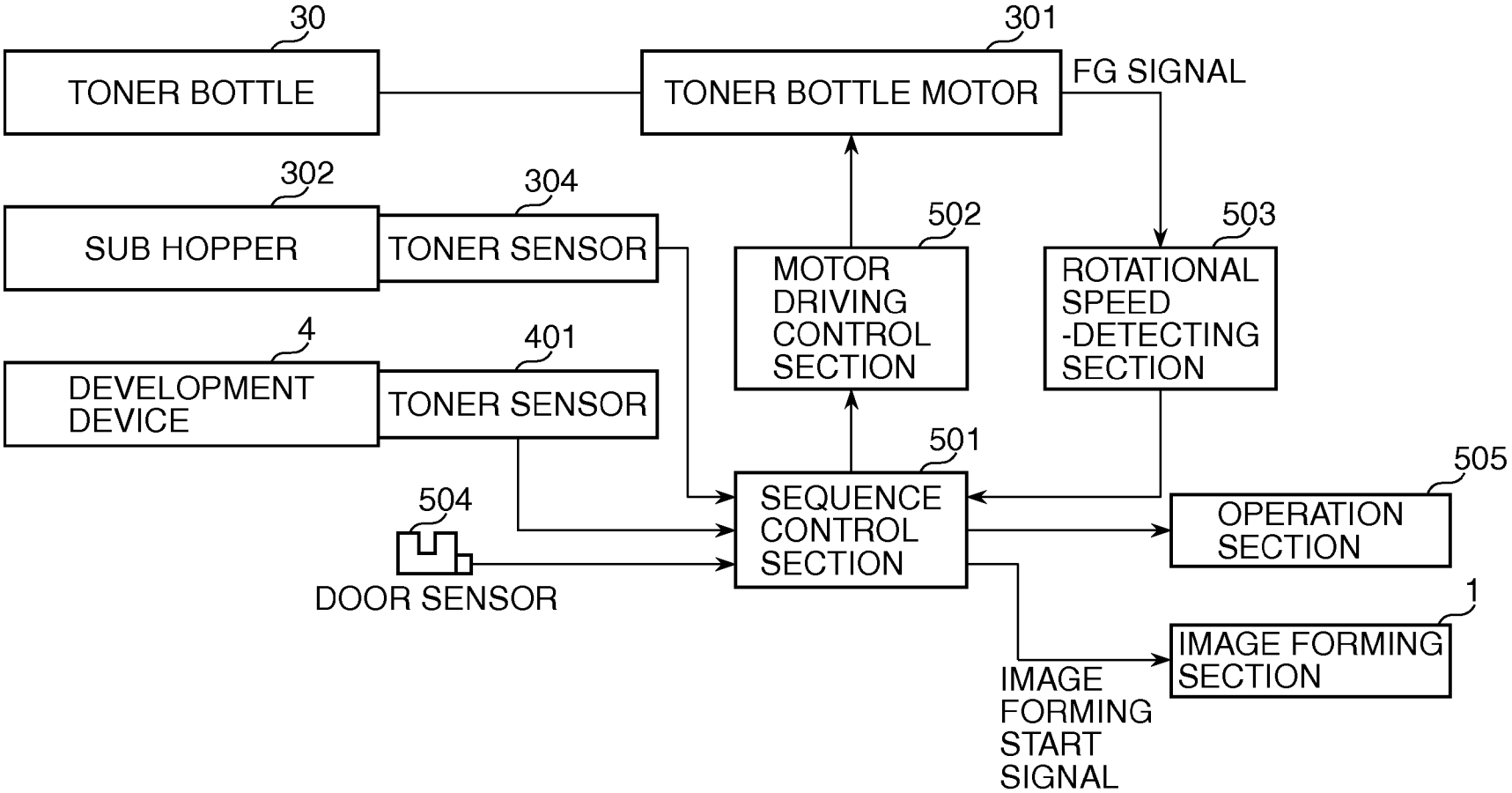
FIG. 5 is a control block diagram of the toner replenishment unit and associated components of the image forming apparatus appearing in FIG. 1.

FIG. 5 is a control block diagram of the toner replenishment unit and associated components of the image forming apparatus in FIG. 1.

Each toner bottle 30 is connected to the toner bottle motor 301 by a gear or the like, and is driven by the toner bottle motor 301. In the present embodiment, the toner bottle motor 301 is a brushless motor with FG signal output (a brush motor may be employed if rotational speed can be detected by an encoder or the like).

The toner bottle motor 301 is connected to a sequence control section 501 via a motor driving control section 502 (four motor driving control sections are provided for the respective four toner bottle motors 301). The motor driving control section 502 is comprised of transistors, FETs, a motor-specific IC, or the like and controls the rotation of the toner bottle motor 301 according to an on-off signal from the sequence control section 501.

A rotational speed-detecting section (rotating state-detecting unit) 503 (four rotational speed-detecting sections are provided) converts the FG signal output from the associated toner bottle motor 301 to the rotational speed using an ASIC or the like (it is also possible to detect rotational speed by directly inputting the FG signal to the sequence control section 501).

Toner is replenished from the toner bottle 30 to the sub hopper 302. The toner sensor (toner presence-detecting unit) 304 which detects whether or not toner is present in the sub hopper 302 is connected to the sequence control section 501 to notify the sequence control section 501 of a result of detection.

The toner sensor 401 within the development device 4 is also connected to the sequence control section 501 to notify the sequence control section 501 of a result of detection.

A door sensor (toner bottle replacement-detecting unit) 504 detects opening/closing of a door which is opened and closed when the toner bottle 30 is replaced, and is connected to the sequence control section 501.

An operation section (display section) 505 is connected to the sequence control section 501 by serial communications and the like and displays a status of the image forming apparatus. An indication for replacement of the toner bottle 30 or the like is also displayed.

An image forming section 1 receives an image forming start signal form the sequence control section 501.

Figure 6:
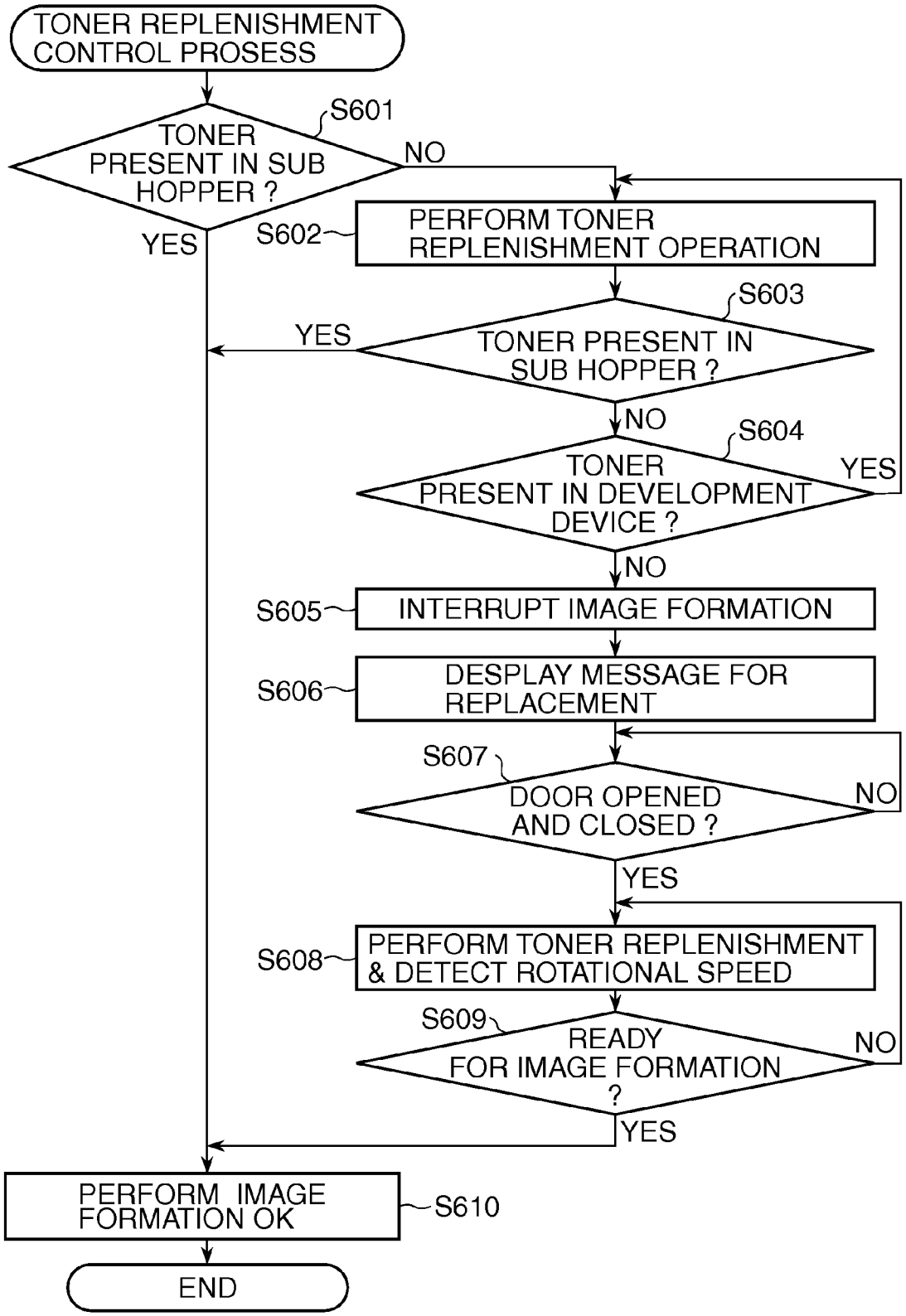
FIG. 6 is a flowchart of a toner replenishment control process which is executed by the toner replenishment unit appearing in FIG. 5.

FIG. 6 is a flowchart of a toner replenishment control process which is executed by the toner replenishment unit appearing in FIG. 5.

A description will be given of the control for toner bottle replacement with reference to the flowchart in FIG. 6. It should be noted that the present toner replenishment control process is executed under the control of the sequence control section 501 in FIG. 5.

The image forming apparatus carries out the toner replenishment control by periodically executing the present process as long as the power is on.

In a step S601, the sequence control section 501 determines based on a signal output from the toner sensor 304 for detecting toner in the sub hopper 302, whether or not the toner is present in the sub hopper 302. If the sequence control section 501 detects (determines) that the toner is present, the sequence control section 501 returns (outputs) the status of "image formation OK" (step S610), whereby the image formation operation is continued.

If the sequence control section 501 detects that the toner is out in the step S601, the sequence control section 501 outputs the ON signal to the motor driving control section 502 to perform a toner replenishing operation by rotating the toner bottle motor 301 (step S602).

Even while rotating the toner bottle 30, the sequence control section 501 detects whether or not the toner is present, using the toner sensor 304 provided in the sub hopper 302 (step S603). Then, if it is detected that the toner is present, the sequence control section 501 returns the status of "image formation OK" (step S610) again to thereby continue the image formation operation.

If the toner sensor 304 in the sub hopper 302 does not detect that the toner is present even though the toner replenishing operation is performed, the process proceeds to a step S604, and the sequence control section 501 detects whether the toner is present in the development device 4, using the toner sensor 401 provided in the development device 4.

If the toner sensor 401 detects that the toner is present, the process returns to the step S602, and the sequence control section 501 continues the toner replenishing operation, and repeats the above-described sequence.

If the toner sensor 401 in the development device 4 detects that the toner is out, the sequence control section 501 interrupts the image formation operation by returning the status of "interruption of the image formation operation" (step S605).

The sequence control section 501 displays a message for prompting the user to replace the toner bottle, on the operation section 505 connected by the serial communications or the like (step S606).

Then, in a step S607, it is determined whether there is a possibility of the user having replaced the toner bottle 30. The sequence control section 501 performs this determination by detecting the signal from the door sensor 504 for the door which is opened and closed when the toner bottle 30 is replaced.

If it is detected that the toner bottle 30 has been replaced, the process proceeds to a step S608, and the sequence control section 501 outputs the ON signal to the motor driving control section 502 to rotate the toner bottle motor 301. In doing this, the sequence control section 501 monitors the FG signal output from the toner bottle motor 301 using the rotational speed-detecting section 503 to detect the rotational speed of the motor 301. Then, the sequence control section 501 calculates the toner replenishment rate based on the detected rotational speed, and determines timing in which image formation is to be resumed according to the calculated tone replenishment rate.

The toner replenishment rate is more than a toner consumption rate during image formation, and further is large enough for the toner sensor 304 to detect that the toner is present, within a predetermined time period.

FIG. 7 is an example of a relationship between the rotational speed of the toner bottle motor appearing in FIG. 5 and the toner replenishment rate.

The timing in which the image formation is to be resumed is determined based on three parameters:

the above-mentioned relationship between the rotational speed of the toner bottle motor and the toner replenishment rate shown in FIG. 7, the volume of toner to be consumed after the toner sensor 304 in the sub hopper 302 detects that the toner is out until the toner sensor 401 in the development device 4 detects that the toner is out (i.e. the capacity of a toner supply passage from the sub hopper 302 to the development device 4), and the toner consumption rate during image formation.

For example, assuming that the above-mentioned volume of toner (capacity of the toner supply passage) is 50 g, and the toner consumption rate during image formation is 1 g per one minute (determined based on image formation speed, an original based on which image formation is assumed to be performed, etc.), the timing in which image formation is to be resumed is determined as follows:

In a case where it is detected by the above-mentioned rotational speed detection that the rotational speed of the toner bottle motor 301 is not more than 20 rpm, if the toner sensor 401 in the development device 4 detects that the toner is present, at a time point it is detected that more 5 g is supplied, it is determined that the apparatus is ready for resuming image formation (step S609).

In this case, it is configured such that even when the operation of the present process is resumed 5 minutes after resuming the image formation, the toner sensor 304 in the sub hopper 302 can detect that the toner is present, at the time (the time period of 5 minutes is set only by way of example, and can be determined according to the rotational speed, and the above-mentioned capacity of the toner supply passage).

Further, for example, in a case where it is detected that the rotational speed of the toner bottle motor 301 is 30 rpm, if the toner sensor 401 in the development device 4 detects that the toner is present, at a time point it is detected that more 30 g is supplied, it is determined that the apparatus is ready for resuming image formation (step S609).

This is also for enabling the toner sensor 304 in the sub hopper 302 to detect that the toner is present, when the operation of the present process is resumed 5 minutes after resuming the image formation.

As in the case of the above-described two examples, the sequence control section 501 determines in the step S609 whether or not the image formation is ready for resuming the image formation, based on the toner replenishment rate, the capacity of the toner supply passage, and the toner consumption rate. Then, the sequence control section 501 causes the image formation to be resumed by returning the status of "the image formation OK" (step S610) when it is determined that the image forming apparatus is ready for resuming the image formation.

Although in the present embodiment, the toner storage unit is formed by the sub hopper 302 and the development device 4, even if the toner storage unit is formed by one of the sub hopper 302 and the development device 4, it is possible to perform control similar to the above-described embodiment.

Further, although in the present embodiment, the rotational speed of the toner bottle motor 301 is detected, electric current flowing therethrough at the time of rotating the motor may be detected to perform the control according to the detected electric current.

Further, although in the present embodiment, the toner bottle replacement-detecting unit is implemented by the door sensor 504, it is possible to perform the same control by detecting attaching/detaching of the toner bottle 30.

Further, although in the present embodiment, the toner sensor 304 and the toner sensor 401 are respectively provided in both of the sub hopper 302 and the development device 4, the toner sensor may be provided in one of the sub hopper 302 and the development device 4.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2008-143167 filed May 30, 2008, which is hereby incorporated by reference herein in its entirety.

What is claimed is:

1. An image forming apparatus comprising:

a motor configured to rotate a toner bottle to convey toner from the toner bottle to a toner storage unit;

a rotating state-detecting unit configured to detect a rotating state of said motor;

a toner presence-detecting unit configured to detect whether or not toner is present in said toner storage unit;

a toner bottle replacement-detecting unit configured to detect that there is a possibility that said toner bottle has been replaced; and a control unit configured to be operable when it is detected by said toner presence-detecting unit that the toner is out, and further it is detected by said toner bottle replacement-detecting unit that there is a possibility that said toner bottle has been replaced, to drive said motor rotate said tonner bottle and determine timing in which image formation is to be first started, after toner bottle replacement, based on the rotating state of said motor detected by said rotating state-detecting unit.

2. The image forming apparatus according to claim 1, wherein said toner storage unit comprises a sub hopper that is disposed between said toner bottle and a development device.

3. The image forming apparatus according to claim 1, wherein said toner storage unit comprises a development device.

4. The image forming apparatus according to claim 1, wherein said toner storage unit comprises a sub hopper disposed between said toner bottle and said development device, and said development device, and said toner presence-detecting unit are disposed in at least one of said sub hopper and said development device.

5. The image forming apparatus according to claim 1, wherein said rotating state-detecting unit detects rotational speed of said motor.

6. Then image forming apparatus according to claim 1, wherein said rotating state-detecting unit detects electric current flowing therethrough when said motor is rotated.

7. The image forming apparatus according to claim 1, wherein said toner bottle replacement-detecting unit detects opening/closing of a door which is opened and closed when said toner bottle is replaced.

8. The image forming apparatus according to claim 1, wherein said toner bottle replacement-detecting unit detects attaching/detaching of said toner bottle.

9. The image forming apparatus according to claim 1, wherein said toner replenishment rate is more than a toner consumption rate during image formation, and is further large enough for said toner presence-detecting unit to detect that the toner is present within a predetermined time period.

10. The image forming apparatus according to claim 1, comprising a display section for notifying a user of necessity of replacement of said toner bottle, and wherein when said toner presence-detecting unit detects that the toner is out, a message for prompting the user to replace said toner bottle is displayed on said display section.

* * * * *